United States Patent [19]

Epler

[11] Patent Number: 4,682,984

[45] Date of Patent: Jul. 28, 1987

[54] DIESEL FUEL ADDITIVE

[76] Inventor: Alan H. Epler, 3303 Rock Springs St., Cheyenne, Wyo. 82001

[21] Appl. No.: 529,109

[22] Filed: Sep. 2, 1983

[51] Int. Cl.[4] ..... C01L 1/02

[52] U.S. Cl. ..... 44/56; 44/53

[58] Field of Search ..... 44/56, 53

[56] References Cited

U.S. PATENT DOCUMENTS

| | | | |
|---|---|---|---|
| 1,259,053 | 3/1918 | Stevens | 44/56 |
| 1,360,872 | 11/1920 | Black | 44/56 |
| 1,361,153 | 12/1920 | Hayes | 44/56 |
| 1,363,870 | 12/1920 | Hayes | 44/56 |
| 1,378,858 | 5/1921 | Hayes | 44/56 |
| 1,428,913 | 9/1922 | Schreiber | 44/56 |
| 1,444,341 | 2/1923 | Garlock | 44/56 |
| 1,474,982 | 11/1923 | Schreiber | 44/56 |
| 1,677,273 | 7/1928 | Costaguta | 44/56 |

*Primary Examiner*—William R. Dixon, Jr.
*Assistant Examiner*—Margaret B. Medley
*Attorney, Agent, or Firm*—Basile Weintraub Hanlon

[57] ABSTRACT

An additive for use with fuel oils, in particular, automotive diesel fuel, consists essentially of a hydrocarbon petroleum distillate, and, in particular, kerosene; an aromatic hydrocarbon solvent and an anhydrous lower aliphatic ether. The ether, which is employed herein, is, preferably, ethyl ether and the aromatic hydrocarbon is, preferably, xylene. Minor amounts of the additive are mixed with the diesel fuel to enhance the efficiency thereof.

10 Claims, No Drawings

DIESEL FUEL ADDITIVE

BACKGROUND OF THE INVENTION

1. Field of the Invention

The present invention concerns fuel additives. More particularly, the present invention concerns a liquid additive for diesel fuels. Even more particularly, the present invention concerns liquid additives for diesel fuels employed in automotive vehicles.

2. Prior Art

Fuel consumption still remains one of the fundamental costs associated in automotive transportation of products, persons and recreation. When this is coupled with diminishing supply potentials, then, the need to increase fuel efficiency and economize becomes ever more apparent.

Over the years, the art has developed and proposed many devices and additives to increase fuel efficiency and to reduce consumption. Yet, little attention has been paid to diesel fuels, per se. Most of the attention has been directed to gasoline consumption. Hence, the art has proposed various types of "screen" devices, intended to break down the gasoline into a "mist"; chemical additives in which the gasoline is entrained and which lowers the temperature of combustion of the gasoline, as well as many other proposals. Generally, these devices and chemicals enjoy limited success.

Diesel fuels, on the other hand, while being lower in cost than gasoline, generate problems not encountered with gasoline. For example, the fuel injectors of the diesel engine have a tendency to become clogged, and varnishes build up. During the wintertime, in low temperature regions, the fuel has a tendency to "gel".

The present invention, as will subsequently be detailed, provides an additive for a vehicular diesel fuel which helps keep the injectors clean, as well as providing an anti-gel for the fuel, per se.

SUMMARY OF THE INVENTION

In accordance with the present invention there is provided an additive, particularly designed for vehicular diesel fuel, and which generally comprises a mixture of aromatic and aliphatic hydrocarbons and a lower aliphatic ether.

The additive, when employed in minor amounts with the diesel fuel reduces fuel consumption, thus, increasing the fuel efficiency of diesel engines.

The additive, generally, comprises from about 75 to about 95 volume percent of a first hydrocarbon, which is a petroleum distillate; from about 2.5 to about 12.5 percent, by volume, of the aromatic hydrocarbon, and from about 2.5 to about 12.5 percent, by volume, of the lower aliphatic ether.

When used with diesel fuel the additive is employed in an amount from about 1 part thereof to 1000 parts of fuel.

For a more complete understanding of the present invention reference is made to the following detailed description and accompanying examples.

DETAILED DESCRIPTION OF THE PREFERRED EMBODIMENTS

As hereinabove noted, the present invention provides an additive, particularly adapted for automotive diesel fuel, which increases the fuel efficiency of a diesel engine employing such fuel, by reducing the amount of fuel consumed by the engine.

At the outset, it should be noted that within the context of the present invention it is contemplated that the term "diesel fuel" means the type which is conventionally employed in automotive environment and which is commonly referred to as "No. 2 diesel fuel". It is in admixture with this fuel in which the present invention evidences its greatest utility. No. 2 diesel fuel is a common, well known, grade of diesel fuel and is widely and generally known.

It should, also, be noted that the present additive can be admixed with gasoline or home heating oil to increase the burning efficiency thereof. However, and as noted hereinabove, it is the automotive diesel fuel with which the additive evidences its greatest efficacy.

The additive, per se, generally, comprises a liquid mixture of first and second hydrocarbons and a lower aliphatic ether.

Each of the components carries out a specific function in its relationship to the diesel fuel environment.

More specifically, the additive hereof consists essentially of a mixture of kerosene, as a first hydrocarbon. Kerosene, which is petroleum distillate, functions as a carrying agent and/or solvent for the other two components within the system, in order to achieve homogeneous blending of the additive with the fuel.

As is known to those skilled in the art to which the present invention pertains, kerosene is a petroleum distillate which generally comprises a mixture of $C_{12}$–$C_{18}$ alkanes, as well as higher aromatics. Generally, kerosene is denoted as having a distillation temperature of about 175° C. to 325° C..

In practicing the present invention the kerosene is generally present in an amount ranging from about 75 percent to about 95 percent, by volume, based upon the total volume of the additive. Preferably, the kerosene is used in an amount ranging from about 80 percent to about 90 percent, by volume, based on the total volume of the additive.

In practicing the present invention it is particularly preferred that number one aviation kerosene be employed as the carrying agent.

The second hydrocarbon component of the additive is an aromatic hydrocarbon. The aromatic hydrocarbon functions, within the context of the present invention, as a cleanser for the injectors used in diesel engines. It also aids in the dispersal of the additive in the fuel. Among the aromatic hydrocarbons which can be used in the practice of the present invention are, for example, benzene, toluene, xylene, napthalene, as well as mixtures thereof. It is preferred, in the practice of the present invention, that the aromatic hydrocarbon be xylene.

The xylene is employed in an amount ranging from about 2.5 percent to about 12.5 percent, by volume, based upon the total volume of the additive, and, preferably from about 5 percent to about 10 percent, by volume, based on the total volume of the additive.

The ether, which is employed in its anhydrous form, appears to serve two functions within the additive. First, the ether lowers the temperature of combustion of the fuel to provide more efficient combustion within the firing chamber; it serves to keep and extract water out of the fuel. Also, it has been evidenced that the ether functions as an anti-gel composition, which is extremely important in cold-weather situations.

The ethers contemplated for use herein are the lower aliphatic ethers, and in particular, the alkane ethers such as for example methyl ether, ethyl ether, methyl ethyl ether, n-propyl ether, isopropyl ether, and the like, as well as mixtures thereof. Preferred within the broad class of useful ethers is anhydrous ethyl ether.

Generally, the ether is employed in an amount ranging from about 2.5 percent to about 12.5 percent, by volume, based upon the total volume of the additive. Preferably, the ether is employed in an amount ranging from about 5 percent to about 10 percent, by volume, based on the total volume of additive.

In preparing the additive hereof, generally, the kerosene, aromatic hydrocarbon, as well as the ether are employed in a respective volumetric ratio of about 9:1:1. Thus, substantially equal parts of the ether and aromatic hydrocarbons are employed in the practice of the present invention.

The additive, which has a flash point of about 120° F., is prepared by simply mixing the components together, at room temperature or lower.

In adding the additive to the diesel fuel, the additive and the diesel fuel are simply blended together by any suitable technique.

Generally, the additive is employed in an amount from about 0.1 to about 10 parts, by volume, thereof, per 1000 parts, by volume, of the diesel fuel. Preferably, from about 0.5 to about 2.5 parts, by volume, of additive is employed per 1000 parts of fuel.

As noted, the additive promotes and increases fuel efficiency of the fuel oil, and when employed in similar amounts, with home heating oil and gasoline evidences the same utility.

Following, are a specific, non-limiting examples of the invention. In the example all parts are by voluem. It is to be understood that the following example is illustrative and not limitative of the present invention.

EXAMPLE I

Into a standard 55 gallon drum was blended, at ambient temperature, 45 gallons of number one aviation kerosene, 5 gallons of ethyl ether and 5 gallons of xylene. The three components were blended together, by stirring, at atmospheric pressure.

The resulting composition was then tested for physical properties in accordance with standard ASTM procedures. The additive had a cloud point of −58° F., a pour poing of −60° F., bomb sulfur of 0.14 wt. percent and evidenced zero ash content.

EXAMPLE II

A 1974 Freight Liner equipped with a 1693 Caterpillar Engine was used as a test vehicle for evaluating the additive hereof. Prior to commencing the test the vehicle was averaging 4.52 miles per gallon.

The testing was started when the vehicle had 124,545 miles on the odometer. Beginning at this point, the vehicle was filled with No. 2 diesel fuel having an additive blended therewith. The additive was that of Example I. The additive was pre-blended with the fuel in 1:1000 part volumetric ratio before filling the vehicle. The fuel and additive mixture was used exclusively as the fuel for the vehicle for approximately sixty days. During the sixty day period the vehicle, which amassed 13,560 miles during that time, evidenced an average fuel consumption of 4.77 miles per gallon—a 5.30 percent increase over that previously observed.

The driving condition during the sixty day test period were substantially the same as the conditions prior thereto.

EXAMPLE III

Example II was repeated using a Big Cam-3 1982 International Cab-over equipped with a Cummins Formula 350 engine. Prior to testing, the vehicle, which had 78,048 miles at the time testing began, had averaged 5.45 miles per gallon.

The fuel and additive composition was used for approximately sixty days, during which time the vehicle traveled 16,547 miles. Driving conditions during the testing period were substantially similar to that prior to testing. During the testing period the vehicle averaged 5.81 miles per gallon which was a 6.2 percent mileage increase over that observed prior to testing.

Having, thus, described the invention what is claimed is:

1. A liquid additive for a liquid fuel, selected from the group consisting of gasoline, diesel oil, and heating oil consisting essentially of:

(a) kerosene, (b) an anhydrous aliphatic ether, and (c) a liquid aromatic hydrocarbon selected from the group consisting of xylene, napthalene and mixtures thereof, the kerosene, ether and hydrocarbon being present in a respective volumetric ratio of about 9:1:1.

2. The additive of claim 1 wherein the aromatic hydrocarbon is xylene.

3. The additive of claim 1 wherein the ether is selected from the group consisting of methyl ether, ethyl ether, n-propyl ether, isopropyl ether, glycol ether and mixtures thereof.

4. The additive of claim 3 wherein the ether is anhydrous ethyl ether.

5. A liquid additive for a liquid fuel selected from the group consisting of gasoline, diesel oil, and heating oil consisting essentially of:

(a) kerosene, (b) anhydrous ethyl ether, and (c) xylene, the kerosene, ether and xylene being present in a respective volumetric ratio of about 9:1:1.

6. The additive of claim 5 wherein the kerosene is present in an amount ranging from about 75 to about 95 percent, by volume, based upon a total volume of the additive, the ether is present in an amount ranging from about 2.5 to about 12.5 percent, by volume, based upon the total volume of the additive and the aromatic hydrocarbon is present in an amount ranging from about 2.5 percent to about 12.5 percent, by volume, based upon the total volume of the additive.

7. The additive of claim 5, wherein the fuel is number 2 diesel fuel.

8. The additive of claim 7, wherein the additive is employed in an amount ranging from about 0.5 to about 2.5 parts, by volume thereof, per 1,000 parts by volume of the diesel fuel.

9. The additive of claim 1 wherein the fuel is a home heating oil.

10. The additive of claim 1 wherein the fuel is gasoline.

* * * * *